US005282694A

United States Patent [19]

Kovacs et al.

[11] Patent Number: 5,282,694

[45] Date of Patent: Feb. 1, 1994

[54] METHOD OF RECLAIMING ABANDONED SETTLING PONDS

[75] Inventors: Mihaly Kovacs; Peter Kovacs; Endro Kovacs, all of Plant City, Fla.

[73] Assignee: Kempco, Inc., Ft. Meade, Fla.

[21] Appl. No.: 977,612

[22] Filed: Nov. 17, 1992

[51] Int. Cl.[5] ..... F02B 11/00

[52] U.S. Cl. ..... 405/36; 37/337; 37/317; 210/170; 405/52; 405/258; 405/303

[58] Field of Search ..... 405/258, 52, 36, 73, 405/74, 303; 37/69, 70, 71, 75-78, 58-60, 62; 210/170

[56] References Cited

U.S. PATENT DOCUMENTS

| | | | |
|---|---|---|---|
| 1,432,489 | 10/1922 | Osterberg | 405/36 |
| 1,460,558 | 7/1923 | Olden | 37/70 |
| 1,760,314 | 5/1930 | Murrey | 210/170 X |
| 2,786,284 | 3/1957 | Todd | 37/70 X |
| 4,016,073 | 4/1977 | Jordan | 405/129 X |
| 4,276,164 | 6/1981 | Marione et al. | 210/170 |
| 4,759,664 | 7/1988 | Deal | 405/258 |

*Primary Examiner*—Dennis L. Taylor
*Attorney, Agent, or Firm*—Dowell & Dowell

[57] ABSTRACT

Settling ponds used in strip mining are reclaimed using lightweight amphibious vehicles which are capable of traversing land, water or clay surfaces and wherein the method consists of pumping clay settled in subsurface areas and spreading the clay remotely over crusted surface areas to thereby create stabilized low profile drainage ditches which extend from low level areas of the ponds to the perimeters thereof to allow water drain off to the perimeter.

17 Claims, 5 Drawing Sheets

METHOD OF RECLAIMING ABANDONED SETTLING PONDS

BACKGROUND OF THE INVENTION

1. Field of the Invention

This invention is directed to methods for reclaiming abandoned settling ponds utilized in strip mining operations by draining water from the ponds while stabilizing such areas by drying clay pumped from subsurface levels and, more particularly, to a method of reclamation wherein lightweight amphibious vehicles are utilized to traverse low level areas. The method utilizes high pressure pumps which withdraw clay from below the surface of the ponds and to distribute the clay remotely on adjacent stabilized or crusted surface areas so that drying of the clay by evaporation and exposure to the sun is promoted. The withdrawal of the clay causes adjacent surface areas to fall creating stabilized ditches of gentle profile which are used to drain water to the perimeter areas of the ponds thereby allowing a relative continuous drainage of water from the ponds while simultaneously facilitating the drying of clay withdrawn therefrom.

Utilizing the methodology of the present invention, low level areas within the ponds may be connected by stabilized drainage ditches or channels to naturally occurring streams, which are also stabilized by removing clay therefrom. The streams extend to the perimeters of the ponds thereby creating a network of drainage ditches which follow natural surface contours thus facilitating the removal of water from the ponds.

2. History of the Related Art

In the strip mining of phosphate and other resources, the phosphate ore is conventionally mixed with water and pumped to processing plants where the ore is washed and graded before being further processed to remove the phosphate from the soil. During the processing, the water which is utilized to convey the phosphate ore is discharged as a watery clay mixture into large settling ponds wherein the water is allowed to slowly seep into the soil. The settling ponds are generally constructed by initially forming earthen dams or dikes around the perimeter of an area. Many times the bottom will have an uneven contour remaining after mining operations. Such dikes often extend as high as fifty feet. Vast acres of land are bordered by such dikes to create settling ponds capable of handling multiple millions of gallons of water and discharged clay per day. To conserve on resources, the clear water from the top of the settling ponds is normally drained off and recycled and used in the conveying and processing of the phosphate ore, however, in some instances, the water may be discharged to adjacent waterways. As the ponds fill with clay, they are abandoned in favor of newly formed settling ponds. After the ponds are closed or abandoned, they must be reclaimed by draining remaining surface waters and allowing the settled clay to dry so that the earth may be reworked to allow its natural use. As the clay dries a crust of dehydrated clay will form on the surface. The underlying clay has a pudding-like consistency and contains of approximately 20% dry solids by weight.

Conventional methods of settling pond reclamation rely on the formation of ditches which extend inwardly from a perimeter ditch dug adjacent to the dike inner wall. These ditches form conveyance channels for drainage of water from the settling ponds. Unfortunately, the degree of ditch formation is severely limited as the surface areas within the ponds are not stable and do not provide sufficient support or bearing capacity for most earthworking equipment. Therefore, ditching is limited to only those perimeter areas wherein conventional backhoes and other types of ditching equipment can be supported on stabilized soil. A further problem with conventional methods is that after ditches have been formed, as water is being drained through the ditches, the underlying clay layer starts to shrink as it dehydrates. This shrinkage causes the surface level to fall as the crust is no longer being supported by the underlying clay.

Parts of the ditches in these areas drop with the surface areas to the extent that the ditch bottom, which was originally sloped toward the perimeter for drainage, now slopes toward the center of the pond and must be reexcavated. In order to maintain the drainage slope toward the perimeter, the ditches must be made deeper as they approach the perimeter. The material removed is deposited on the surface adjacent to the deepened ditch. This additional weight on the crust coupled with the greater depth causes clay to flow from the subsurface areas into the ditch and the ditch walls to collapse, thereby interrupting the drainage of water and inhibiting the reclamation process.

SUMMARY OF THE INVENTION

This invention is directed to a method for reclaiming settling ponds utilized to retain clay from manufacturing processes wherein lightweight amphibious vehicles are maneuvered into low level areas of the ponds. The vehicles carry a pumping apparatus which is inserted through the crust layer of the ponds and is activated to remove subsurface clay. Removal of the clay causes the adjacent ground level to fall. As a vehicle moves forward a low profile ditch is formed to create drainage for surface waters. This process is continued through the low level areas within the pond and through any natural streams which may have formed. The ditches communicate with low areas along a dike system which surrounds the pond and where openings may be dug for drainage. With the drainage of the surface waters the top clay layer begins to dehydrate and shrink, thereby causing the ground level in the ditch area to fall making the ditches more effective for water removal.

The removed clay is sprayed in a thin layer (max. 6") over an area of 25 to 150 feet from the pumping site. Limiting the clay layer promotes drying and builds up the thickness of the dried crust making it more stable to support heavier equipment. Within a few weeks the surface deposited clay layer has dehydrated and shrunk to a small fraction of its original thickness and has become a part of the crust. The thickened crust is built up to a point where it will support conventional equipment.

As pond dehydration continues, the pumping process is repeated after a few weeks to deepen the ditches and further build up the crust layers.

It is a primary object of the present invention to provide an economical method for reclaiming settling ponds which reduces the amount of conventional ditching required by utilizing pumps to withdraw subsurface clay and remotely deposit it onto hardened or crusted surface areas and thereby form low profile drainage ditches which are not easily closed by the influx of adjacent clay.

It is a further object of the present invention to provide an extremely efficient method for reclaiming settling ponds by draining surface waters and exposing removed clay for evaporation wherein low profile drainage ditches are formed through areas of low level where water is trapped and by interconnecting such low level water filled areas following the natural surface contours and channeling the water to perimeter areas where the water is discharged from the settling ponds.

It is yet another object of the present invention to provide a method for draining settling ponds that reduces the water table throughout the ponds at an accelerated rate thereby allowing heavier conventional construction equipment to enter the area to reshape the surface contours well in advance of the time necessary utilizing conventional techniques.

It is also an object of the present invention to provide a method for reclaiming settling ponds wherein channels or ditches are created in low level areas by pumping clay from subsurface areas and wherein the clay is remotely spread over crusted areas where the clay is readily dried through natural evaporation thus increasing the surface thickness and load bearing capacity of the adjacent crusted areas in a manner which is not possible utilizing conventional reclamation techniques.

DESCRIPTION OF THE PREFERRED EMBODIMENT

Figure 1:
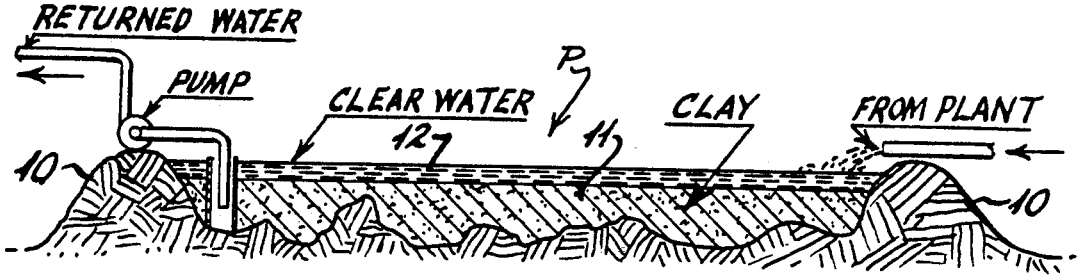
FIG. 1 is an illustrational cross-sectional view through a working settling pond.

With continued reference to the drawings, FIG. 1 is a cross-sectional view taken through an active settling pond P of the type utilized in phosphate strip mining operations. The settling pond is created by forming an earthen dike or dam 10 around the periphery of the land area into which water and clay is deposited. Often, such dikes will extend over fifty feet in height from the normal earthen surface. During strip mining operations, the water and waste from the processing of the ore is discharged into the settling pond and the clay allowed to settle as indicated in layer 11. As settling occurs, the clear water 12 remains on top of the pond and this water is drained off and utilized in continued mining operations.

Figure 2:
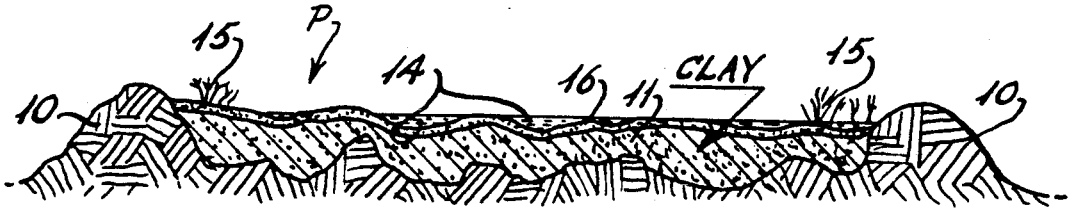
FIG. 2 is an illustrational cross-sectional view through an abandoned or closed settling pond.

Once the settling pond is filled with clay and sludge, as shown in FIG. 2, it is abandoned in favor of a new settling pond. After the settling pond has been abandoned, it is necessary to take active steps to reclaim the land by removing remaining water therefrom and permitting the clay and sludge to dry so that the land can be worked with conventional equipment.

As the settling ponds begin to dry, pools or lakes are formed in low level areas, as is shown at 14. The areas of higher elevation begin to crust and vegetation growth 15 is initiated. The crust 16 is relatively thin (4"–6") and typically will not support the weight of heavy earthmoving equipment. The problem in the reclamation of the settling ponds is to provide for the removal of the surface waters from low level areas to allow an accelerated drying of the clay so that the earth may be reworked utilizing conventional construction equipment to bring it to its original state.

Figure 3:
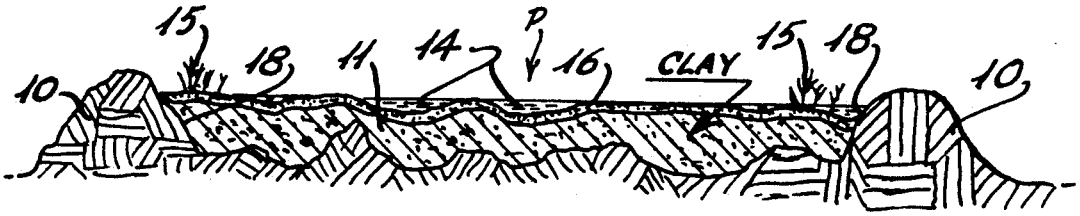
FIG. 3 is an illustrational cross-sectional view through an abandoned settling pond in which conventional reclamation work has started.
Figure 4:
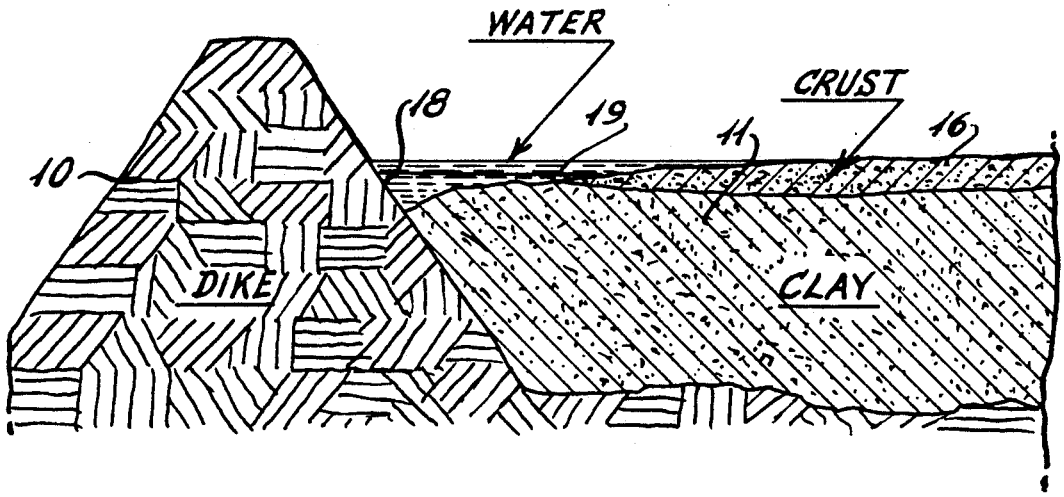
FIG. 4 is an enlarged sectional view of FIG. 3 showing a prior art drainage channel formed using conventional backhoe and other related equipment and showing the relationship between the newly created ditch and the adjacent crust and clay layers in the pond.
Figure 5:
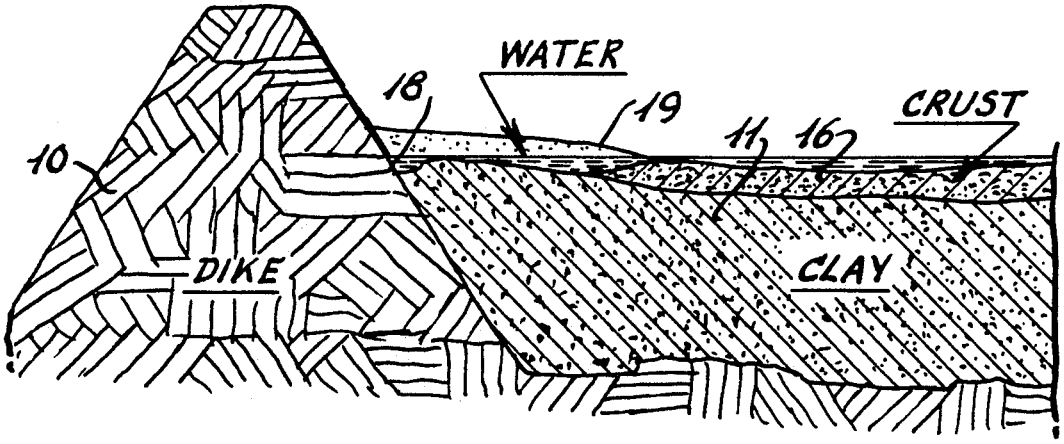
FIG. 5 is an enlarged sectional view of the area shown in FIG. 4 showing the deterioration of the ditch area with the encroachment of clay into the previously open channel and drainage slope change due to dewatering and shrinkage of the underlying clay.

With specific reference to FIGS. 3–5, a conventional method of land reclamation is disclosed. Conventionally, due to the inability to operate heavy equipment within the settling pond P, initial steps are made utilizing construction equipment which is supported along the dikes 10 to form perimeter channels 18 for promoting de-watering of the area adjacent to the dikes. The water may be conveyed through openings in the dike to naturally occurring streams or riverbeds, or to other processing or treatment areas. As the land adjacent the dikes begins to harden due to the water removal, conventional construction equipment, such as backhoes, are used to dig ditches 19 extending inwardly of the ponds. The extent to which the ditches 19 may be excavated is limited by the ability of the crust 16 within the settling pond to support such equipment. Conventionally, such ditches extend only a short distance into the central area of the settling pond and frequently do not extend into the low level areas wherein the pools or lakes 14 are formed.

With conventional reclamation techniques, the ditches must be continuously maintained to promote drainage. FIG. 4 shows a section through a freshly dug ditch. The ditch 19 is sloped so that it drains to the perimeter ditch 18. Material removed from the ditch is deposited on the adjacent surface. Several factors work against this method being effective.

As the ditch drains water from the area the underlying clay starts to dehydrate and shrink causing the adjacent surface area to fall. The clay strata at the perimeter is thinner due to the dike base so it will remain close to the original level. The perimeter area does not readily dehydrate and shrink due to water remaining in the perimeter ditch 18. This causes the pond surface to start to assume a saucer-like contour. The inner extremes of the ditches 19 fall with the surface to a point where the bottom contour of the ditches 19 no longer slope to drain to the perimeter ditch 18, as shown in FIG. 5. At this point the ditch must be reworked to restore drainage to the perimeter ditch 18. The depth of the perimeter ditch must also be increased to effectively drain the area. The increased depth of the ditch plus the weight of the adjacently deposited removed material work to cause the ditch walls to collapse and fill with clay.

Figure 8:
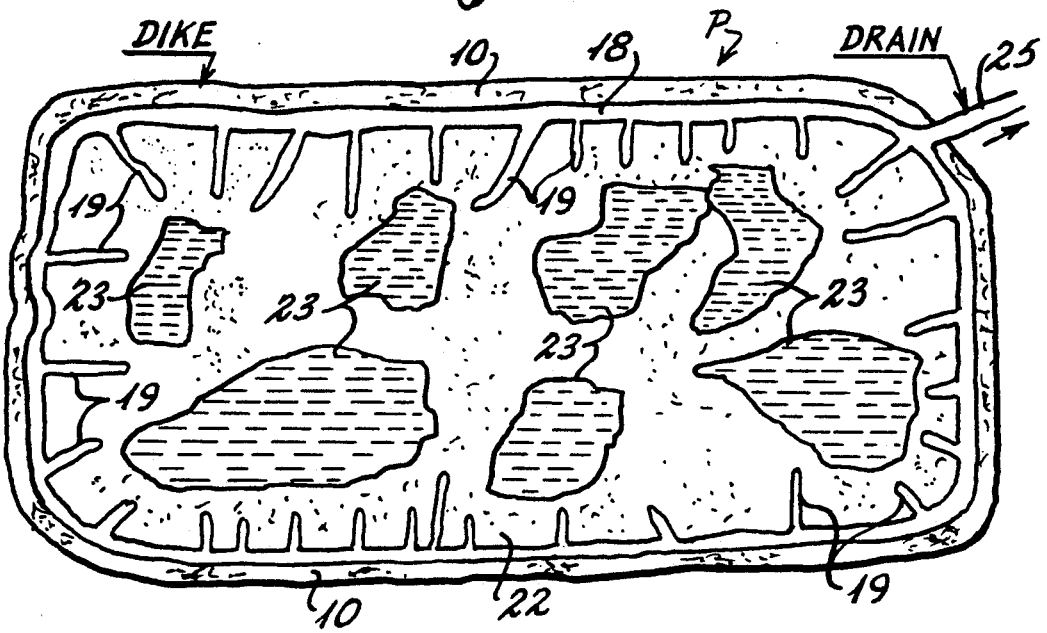
FIG. 8 is a topographical view of a settling pond being reclaimed with conventional methods.

FIG. 8 shows a plan of a typical pond using conventional methods for drainage. The pond is surrounded by a dike 10 into which an opening 25 has been dug to allow drainage. A perimeter ditch 18 has been dug around and adjacent to the dike wall 10. Natural drying has resulted in several low spots 23 some of which contain surface water. Ditching 19 has been extended from the perimeter ditch 18 toward the low spots in an effort to drain the water. This can only progress to a point where the crust will support conventional equipment.

The conventional process requires that the ditches 19 be worked until the adjacent surface areas are dewatered to an extent that the underlying clay begins to harden to provide sufficient ground bearing support for allowing conventional heavy construction equipment to traverse the surface. At this point, ditching may be extended further into the settling pond.

Figure 6:
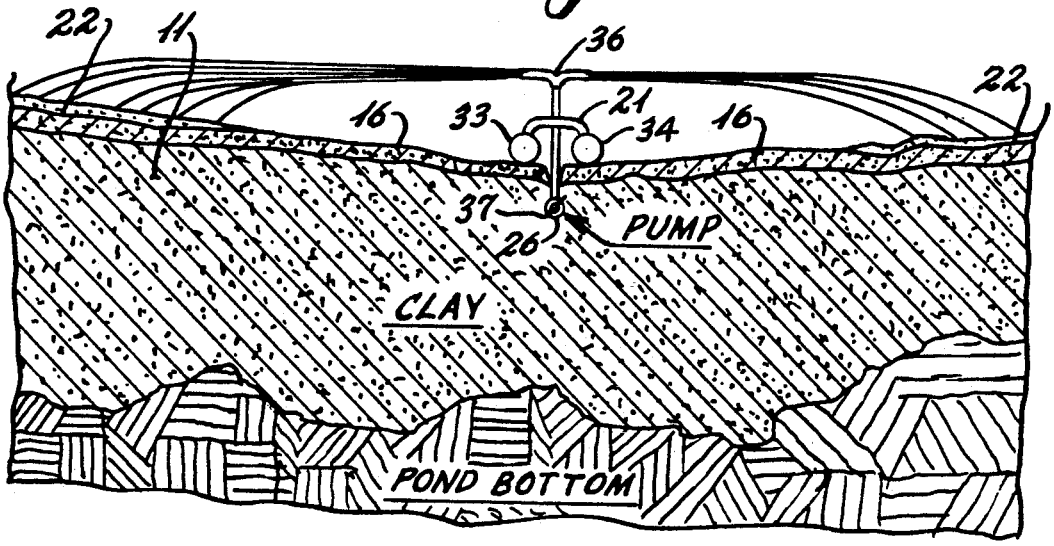
FIG. 6 is a sectional view through a settling pond in which reclamation work has started using the teachings of the present invention. Clay is being pumped from subsurface areas to create a sinkhole effect with the removed clay being remotely spread over the crust to dry and strengthen the crust layer.
Figure 7:
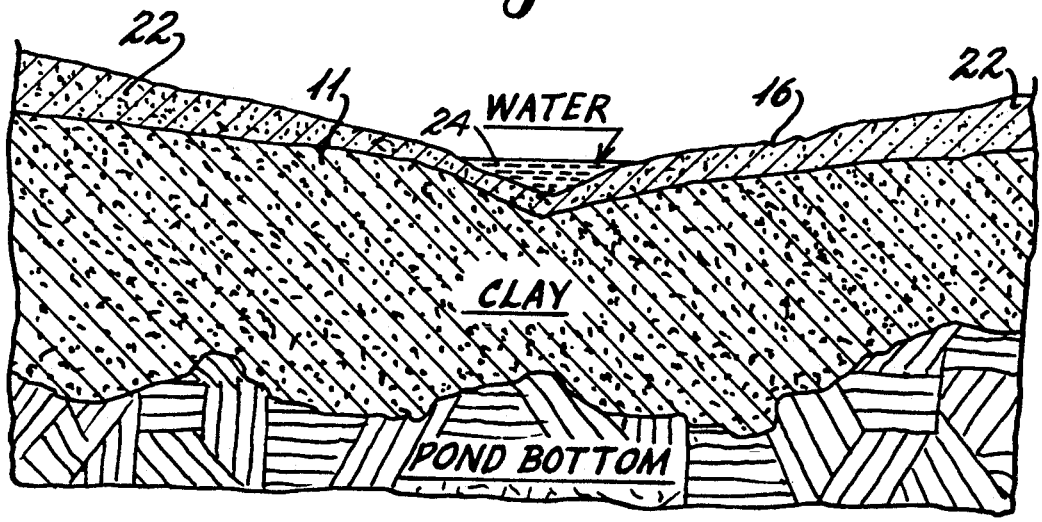
FIG. 7 is a sectional view through the area shown in FIG. 5 showing the gently sloping ditch created by the teachings of the present invention with the build up in crust thickness in remote areas.
Figure 9:
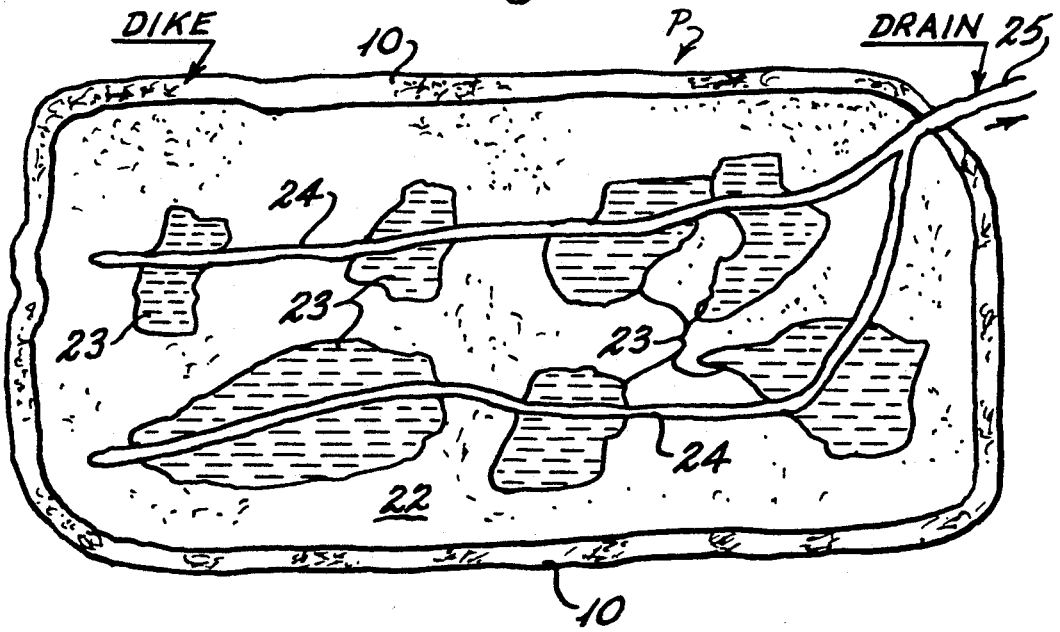
FIG. 9 is a topographical view of the settling pond shown in FIG. 8 showing a first reclamation method of the present invention.

The process of land reclamation of the present invention is disclosed more specifically in FIGS. 6, 7 and 9. FIG. 9 is a top plan view of a conventional abandoned settling pond P similar to that shown at FIG. 8, showing the lakes and pools 23 of water which accumulate in the low level areas of the settling pond. As opposed to conventional processes, the reclamation process of the present invention is defined by providing ditches 24 which extend into and interconnect the low level areas, with such ditches being formed from the inside of the settling ponds and extending outwardly through channels 25 formed in the dikes 10. Utilizing the process of the present invention it is possible to interconnect each of the low lying areas in which water is retained and allow such areas to be drained by following the natural ground contour formed within the settling ponds so that the ditches are established between areas of higher elevation wherein surface crust is formed and growth of vegetation initiated. In some instances, the ditches or channels 24 may communicate with naturally occurring streams within the pond. Such streams may also be reformed using the methodology of the present invention.

In order to create the ditches or channels 24 extending from the central portion of the settling pond outwardly to the perimeter thereof, it is necessary to utilize a vehicle which is operable on water and maneuverable in sludge and clay. Therefore, a lightweight amphibious vehicle 21 which is floatable upon water is utilized. In FIG. 6 the vehicle is shown as including rotary driven hollow pontoons 33 and 34 which support the frame of the vehicle in an elevated position with respect to the water. Appropriate power means are provided on the vehicle for rotating the drums which drums are provided with fluted surfaces for purposes of creating propulsion through water and clay. One such type of vehicle is disclosed in applicants' copending application Ser. No. 07/906,446, filed Jun. 30, 1992, entitled AMPHIBIOUS LAND RECLAMATION VEHICLE.

With particular reference to FIG. 6, the lightweight amphibious vehicle 21 carries a high pressure centrifugal pump 26 to which is mounted a discharge line 36. The pump extends downwardly relative to the vehicle and through thin crusted surface areas so that it is located within the clay layer 11 of the settling pond. The pump is inserted well within the clay layer to avoid pumping of water. In order to allow pumping of the clay, a mechanical agitator, such as a rotatable blade 37 may be mounted adjacent to the pump which blade is used to mix the pudding consistency clay to a pumpable condition. The discharge from the pump is spread over adjacent crust areas not closer than 25 feet from the vehicle and may extend up to 150 feet. This layer of clay 22 is held to a maximum thickness of approximately 6 inches to reduce drying time. Care is given to avoid any mixing of the clay with water as this would slow drying. As the deposited clay layer 22 dehydrates and shrinks it becomes a part of the original crust 16 thereby increasing its thickness and ability to support heavier equipment.

With the removal of the underlying clay the surface area falls carrying with it the original surface crust creating a controlled type of sink hole which forms the walls of the gently sloped ditch. The ditching process may be repeated after several weeks to increase the depth of the ditches and further increase the bearing capacity of the crust.

As the lightweight vehicle continues to move through the low level areas wherein water has pooled, such as shown at 23 in FIG. 9, the underlying clay is discharged from beneath the vehicle to the adjacent crusted surface areas. This action creates primary ditches 24 which ditches are of a low, generally concave profile, as is shown in FIG. 7, wherein the width of the ditches far exceed the depth dimension thereof. Such a profile for the ditches allows them to remain open after the vehicle has passed as the side walls of the ditch are gently inclined as opposed to the rectilinear ditching accomplished with conventional methods. It has been found that ditches formed in this manner remain open and maintain drainage as the adjacent clay 11 does not fill in as rapidly into the low profiled area of the ditch. A typical ditch may be eight to nine feet wide and, with the underlying clay having been removed, the tendency of back-filling of the ditch by adjacent clay layers is effectively eliminated. The pumping of the clay not only creates a ditch for water drainage but improves drainage into the ditch by lowering the adjacent land levels, as is shown by the concave configuration shown in FIG. 7. The concavity of the ditch may extend as much as twenty-five feet on either side of the location of the vehicle.

The initial step in reclamation of a pond would be to locate the drainage points adjacent to the inside wall of the retaining dike. The ditching is planned to traverse throughout the low areas of the pond to lead to these drainage points.

Utilizing the method of the present invention the operator of the vehicle initiates pumping within the central portion of the settling pond at the low level areas in which water has collected and continues ditching towards the drainage points along the perimeter of the settling pond. In this manner, low level areas 23 are interconnected by the ditches 24 which extend out to the perimeter. It should be noted that in some cases, water may be pumped from the drainage points over the dike wall as cutting a drainage channel through the dike wall may impose some regulatory time limits.

In FIG. 9, a channel 25 extending through the outer dike 10 is shown which is connected to the ditches 24. The channel through the dike may be created by conventional earthworking equipment. Utilizing the lightweight vehicle of the present invention and the concept of removing from low level areas the underlying clay by pumping the clay to adjacent crusted surface areas, the operator of the lightweight equipment can work through an entire pond including any standing water and marshy areas. The clay which is pumped over wide areas of the crust is allowed to dry in a very efficient manner. Further, in some instances, the ditches 24 may communicate with existing streams within the pond. In such instances, the streams are also traversed by the vehicle and clay pumped therefrom.

Figure 10:
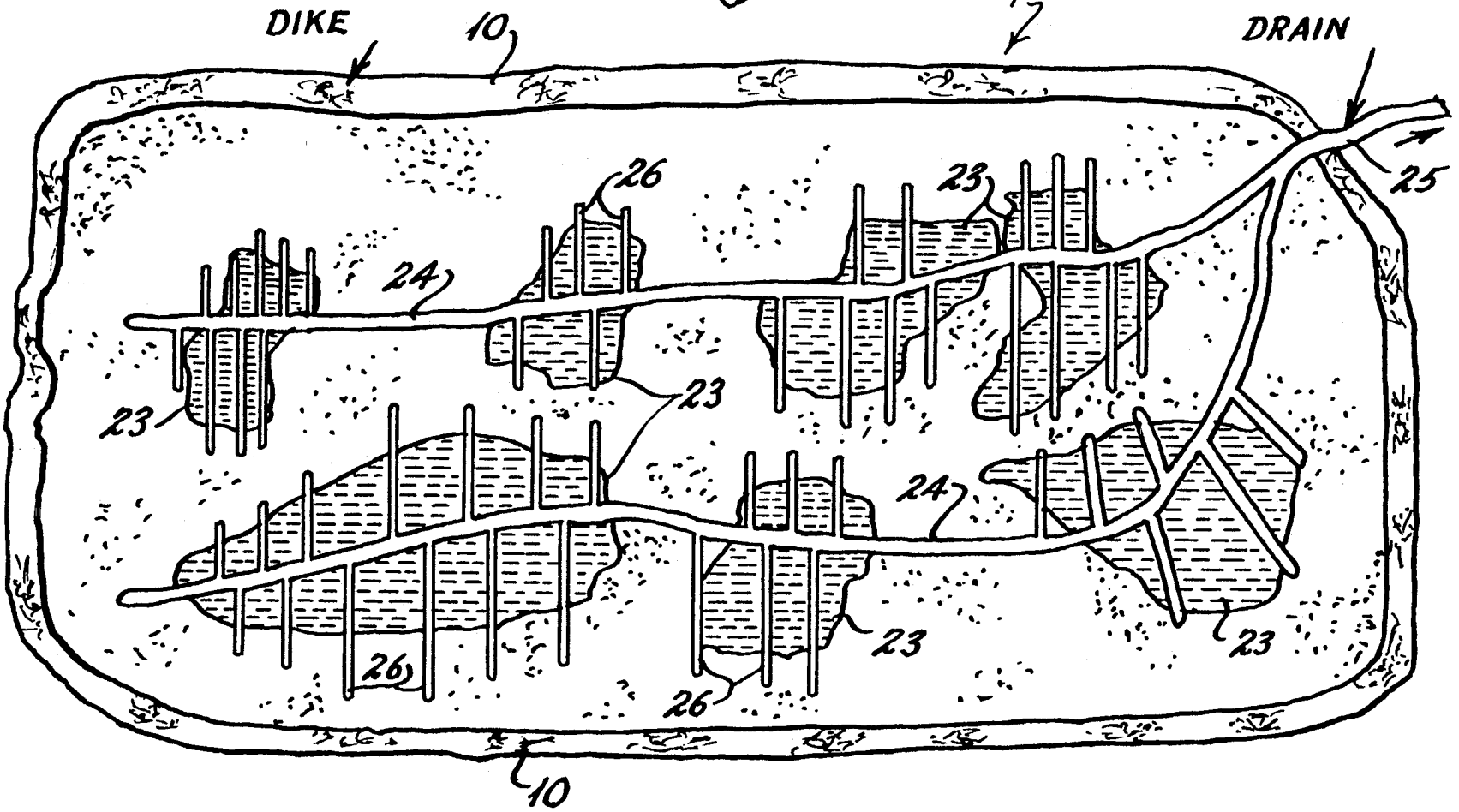
FIG. 10 is a topographical view of the settling pond of FIG. 9 showing a second reclamation method of the present invention.

If there is no time limit to complete the reclamation, the pond can be dried up in 3–5 years by simply maintaining positive drainage in the existing primary ditches 24. If, however, the owner wants the land reclaimed as soon as possible, additional ditching would be required, as shown in FIG. 10. A waiting period of 2–3 months after the initial main ditching would allow drainage of the majority of the surface water. At this point, lateral perpendicular ditches 26 would be dug as required along the primary ditches to speed up the dewatering process. Using this technique, reclamation could be accomplished in about 2 years.

We claim:

1. A method of reclaiming abandoned settling ponds defined by peripheral and central areas by draining pools of water from low levels within the central areas and wherein clay is located beneath the pools of water and beneath crusted surfaces within the central area comprising the steps of:

a) forming low profile drainage ditches extending from the low levels within the central area toward the peripheral areas of the ponds by pumping the clay from beneath the low level areas; and b) depositing the clay on remote crusted surfaces.

2. The method of claim 1 in which the low profile drainage ditches are created to connect the pools of water by pumping the clay from beneath the crusted surfaces.

3. The method of claim 2 in which the clay is deposited at least approximately 25 feet from the low profile drainage ditches.

4. The method of claim 3 in which the clay is deposited in layers of generally not greater than six inches in thickness to thereby promote the drying thereof.

5. The method of claim 4 in which the clay is deposited between approximately 25 feet to 150 feet from the low profile drainage ditches.

6. The method of claim 5 including the additional step of mixing the clay to a pumpable consistency prior to pumping the clay.

7. The method of claim 1 including the additional step of mixing the clay to a pumpable consistency prior to pumping the clay.

8. The method of claim 1 in which the clay is deposited in layers of generally not greater than six inches in thickness to thereby promote the drying thereof.

9. The method of claim 8 in which the clay is deposited at least approximately 25 feet from the low profile drainage ditches.

10. A method of reclaiming abandoned settling ponds utilizing a lightweight amphibious vehicle capable of traversing water and clay, and wherein the settling ponds are defined by peripheral and central areas, by draining pools of water from low levels within the central areas and wherein clay is deposited beneath the water and beneath adjacent crusted surfaces comprising the steps of:

a) traversing the central areas utilizing the lightweight amphibious vehicle;

b) connecting the pools of water in the low level areas by forming low profile drainage ditches through the crusted surfaces extending therebetween by pumping the clay from beneath the crusted surfaces; and c) draining the water from said low profile ditches to the peripheral area of the settling pond to thereby allow drainage of water from the pond.

11. The method of claim 10 including the step of spraying the clay on crusted surfaces spaced from the low profile drainage ditches to thereby allow natural drying of the sprayed clay.

12. The method of claim 11 in which the sprayed clay is deposited in layers of generally less than six inches.

13. The method of claim 12 in which the sprayed clay is deposited at least approximately 25 feet from the low profile drainage ditches.

14. The method of claim 11 in which the sprayed clay is deposited at least approximately 25 feet from the low profile drainage ditches.

15. A method of reclaiming abandoned settling ponds defined by peripheral and central areas by draining water from low levels within the central areas and wherein clay is deposited beneath the water and beneath crusted surfaces having low load bearing capacities within the central area comprising the steps of:

a) pumping the clay from beneath portions of the crusted surfaces and allowing the crusted surfaces to sink into said portions to form low profile water drainage channels extending within the low level central areas; and b) increasing the load bearing capacity of other portions of the crusted areas by depositing the pumped clay thereon and allowing the deposited clay to dry.

16. The method of claim 15 including the additional step of mixing the clay to a flowable consistency prior to pumping the clay.

17. The method of reclaiming abandoned settling ponds of claim 15 in which the low profile drainage ditches are formed so as to drain the water from the low level areas to the peripheral areas.

* * * * *